US006864840B2

(12) United States Patent
Zhu et al.

(10) Patent No.: US 6,864,840 B2
(45) Date of Patent: Mar. 8, 2005

(54) SERIALLY-FED PHASED ARRAY ANTENNAS WITH DIELECTRIC PHASE SHIFTERS

(75) Inventors: Yongfei Zhu, Columbia, MD (US); Louise C. Sengupta, Ellicott City, MD (US); Andrey Kozyrev, St. Petersburg (RU); Xubai Zhang, Columbia, MD (US)

(73) Assignee: Paratek Microwave, Inc., Columbia, MD (US)

( * ) Notice: Subject to any disclaimer, the term of this patent is extended or adjusted under 35 U.S.C. 154(b) by 276 days.

(21) Appl. No.: 10/060,560

(22) Filed: Jan. 30, 2002

(65) Prior Publication Data

US 2002/0126048 A1 Sep. 12, 2002

Related U.S. Application Data

(63) Continuation of application No. 09/660,719, filed on Sep. 13, 2000, now Pat. No. 6,377,217.
(60) Provisional application No. 60/153,859, filed on Sep. 14, 1999.

(51) Int. Cl.[7] ..... H01Q 1/38

(52) U.S. Cl. ..... 343/700 MS; 343/771

(58) Field of Search ..... 343/909, 700 MS, 343/771, 343, 767, 778, 829, 84

(56) References Cited

U.S. PATENT DOCUMENTS 4,710,775 A * 12/1987 Coe ..... 343/727
5,043,738 A * 8/1991 Shapiro et al. ..... 343/700 MS
5,589,845 A * 12/1996 Yandrofski et al. ..... 343/909
6,377,217 B1 * 4/2002 Zhu et al. ..... 343/700 MS

* cited by examiner

*Primary Examiner*—James Vannucci
(74) *Attorney, Agent, or Firm*—Robert P. Lenart; Michael N. Haynes; James S. Finn

(57) ABSTRACT

A phased array antenna includes a plurality of radiating elements, a feed line assembly, a ground plane positioned between the plurality of radiating elements and the feed line assembly, with the ground plane having a plurality of openings positioned between the plurality of radiating elements and the feed line assembly, and a plurality of voltage tunable dielectric phase shifters coupled to the feed line assembly.

20 Claims, 6 Drawing Sheets

SERIALLY-FED PHASED ARRAY ANTENNAS WITH DIELECTRIC PHASE SHIFTERS

CROSS REFERENCE TO RELATED PATENT APPLICATION

This application is a continuation of U.S. patent application Ser. No. 09/660,719, filed Sep. 13, 2000, now U.S. Pat. No. 6,377,217 which claims the benefit of U.S. Provisional Patent Application Ser. No. 60/153,859, filed Sep. 14, 1999.

FIELD OF INVENTION

The present invention relates generally to phased array antennas, and more particularly to microstrip patch antennas having coplanar waveguide (CPW) voltage-tuned phase shifters.

BACKGROUND OF INVENTION

A phased array refers to an antenna having a large number of radiating elements that emit phased signals to form a radio beam. The radio signal can be electronically steered by the active manipulation of the relative phasing of the individual antenna elements. The electronic beam steering concept applies to antennas used with both a transmitter and a receiver. Electronically scanned phased array antennas are advantageous in comparison to their mechanical counterparts with respect to speed, accuracy, and reliability. The replacement of gimbals in mechanically scanned antennas with electronic phase shifters in electronically scanned antennas increases the survivability of antennas used in defense systems through more rapid and accurate target identification. Complex tracking exercises can also be maneuvered rapidly and accurately with a phased array antenna system.

Phase shifters play key role in operation of phased array antennas. Electrically controlled phase shifters can utilize tunable ferroelectric materials, whose permittivity (more commonly called dielectric constant) can be varied by varying the strength of an electric field to which the materials are subjected. Even though these materials work in their paraelectric phase above the Curie temperature, they are conveniently called "ferroelectric" because they exhibit spontaneous polarization at temperatures below the Curie temperature. Tunable ferroelectric materials including Barium Strontium Ttitanate (BST) or BST composites have been the subject of several patents.

Dielectric materials including barium strontium titanate are disclosed in U.S. Pat. No. 5,312,790 to Sengupta, et al. entitled "Ceramic Ferroelectric Material"; U.S. Pat. No. 5,427,988 to Sengupta, et al. entitled "Ceramic Ferroelectric Composite Material-BSTO-MgO"; U.S. Pat. No. 5,486,491 to Sengupta, et al. entitled "Ceramic Ferroelectric Composite Material - BSTO-$ZrO_2$"; U.S. Pat. No. 5,635,434 to Sengupta, et al. entitled "Ceramic Ferroelectric Composite Material—BSTO-13 Magnesium Based Compound"; U.S. Pat. No. 5,830,591 to Sengupta, et al. entitled "Multilayered Ferroelectric Composite Waveguides"; U.S. Pat. No. 5,846,893 to Sengupta, et al. entitled "Thin Film Ferroelectric Composites and Method of Making"; U.S. Pat. No. 5,766,697 to Sengupta, et al. entitled "Method of Making Thin Film Composites"; U.S. Pat. No. 5,693,429 to Sengupta, et al. entitled "Electronically Graded Multilayer Ferroelectric Composites"; and U.S. Pat. No. 5,635,433 to Sengupta, entitled "Ceramic Ferroelectric Composite Material-BSTO-ZnO". These patents are hereby incorporated by reference.

A copending, commonly assigned U.S. patent application titled "Electronically Tunable Ceramic Materials Including Tunable Dielectric And Metal Silicate Phases", by Sengupta, filed Jun. 15, 2000, discloses additional tunable dielectric materials and is also incorporated by reference. The materials shown in these patents, especially BSTO—MgO composites, show low dielectric loss and high tunability. Tunability is defined as the fractional change in the dielectric constant with applied voltage.

Tunable phase shifters using ferroelectric materials are disclosed in U.S. Pat. No. 5,307,033, 5,032,805, and 5,561,407. These phase shifters include a ferroelectric substrate as the phase modulating elements. The permittivity of the ferroelectric substrate can be changed by varying the strength of an electric field applied to the substrate. Tuning of the permittivity of the substrate results in phase shifting when an RF signal passes through the phase shifter. The ferroelectric phase shifters disclosed in those patents suffer high conductor losses, high modes, DC bias, and impedance matching problems at K (18 to 27 GHz) and Ka (27 to 40 GHz) bands.

One known type of phase shifter is the microstrip line phase shifter. Examples of microstrip line phase shifters utilizing tunable dielectric materials are shown in U.S. Pat. Nos. 5,212,463; 5,451,567 and 5,479,139. These patents disclose microstrip lines loaded with a voltage tunable ferroelectric material to change the velocity of propagation of a guided electromagnetic wave. U.S. Pat. No. 5,561,407 discloses a microstrip voltage-tuned phase shifter made from bulk ceramic. Bulk microstrip phase shifters suffer from the need for higher bias voltage, complex fabrication processing and high cost. Coplanar waveguides can also serve as phase shifters. U.S. Pat. Nos. 5,472,935 and 6,078,827 disclose coplanar waveguides in which conductors of high temperature superconducting material are mounted on a tunable dielectric material. The use of such devices requires cooling to a relatively low temperature. In addition, U.S. Pat. Nos. 5,472,935 and 6,078,827 teach the use of tunable films of $SrTiO_3$, or (Ba, Sr)$TiO_3$ with high a ratio of Sr. $SrTiO_3$, and (Ba, Sr)$TiO_3$ have high dielectric constants, which results in low characteristic impedance. This makes it necessary to transform the low impedance phase shifters to the commonly used 50-ohm impedance.

U.S. Pat. No. 5,617,103 discloses a ferroelectric phase shifting antenna array that utilizes ferroelectric phase shifting components. The antennas disclosed in that patent utilize a structure in which a ferroelectric phase shifter is integrated on a single substrate with plural patch antennas. Additional examples of phased array antennas that employ electronic phase shifters can be found in U.S. Pat. Nos. 5,079,557; 5,218,358; 5,557,286; 5,589,845; 5,917,455; and 5,940,030.

It would be desirable to have a phased array antenna, which utilizes low cost phase shifters that can operate at room temperature and at high frequencies, such as above Ku band (12 to 18 GHz). This could play an important role in helping to make electronically scanned phased array antennas practical for commercial applications.

SUMMARY OF INVENTION

A phased array antenna includes a plurality of radiating elements, a feed line assembly, a ground plane positioned between the plurality of radiating elements and the feed line assembly, with the ground plane having a plurality of openings positioned between the plurality of radiating elements and the feed line assembly, and a plurality of voltage tunable dielectric phase shifters coupled to the feed line assembly.

Antennas constructed in accordance with this invention utilize low loss tunable film dielectric elements and can operate over a wide frequency range. The conductors forming the coplanar waveguide operate at room temperature. The devices herein are unique in design and exhibit low insertion loss even at frequencies in the above Ku band (12 to 18 GHz).

BRIEF DESCRIPTION OF THE DRAWINGS

A full understanding of the invention can be gained from the following description of the preferred embodiments when read in conjunction with the accompanying drawings in which.

DETAILED DESCRIPTION OF THE INVENTION

The preferred embodiment of the present invention is an electrically scanned phased array antenna including voltage-tuned coplanar waveguide (CPW) phase shifters and circularly polarized aperture-coupled microstrip patch elements. The CPW phase shifters include voltage-tuned dielectric films, whose dielectric constant (permittivity) may be varied by varying the strength of an electric field applied thereto. The tuning of the permittivity of the substrate results in phase shifting when a radio frequency (RF) signal passes through the CPW line. The films can be deposited by standard thick/thin film process onto low dielectric loss and high chemical stability subtracts, such as MgO, $LaAlO_3$, sapphire, $Al_2O_3$, and a variety of ceramic substrates.

Figure 1:
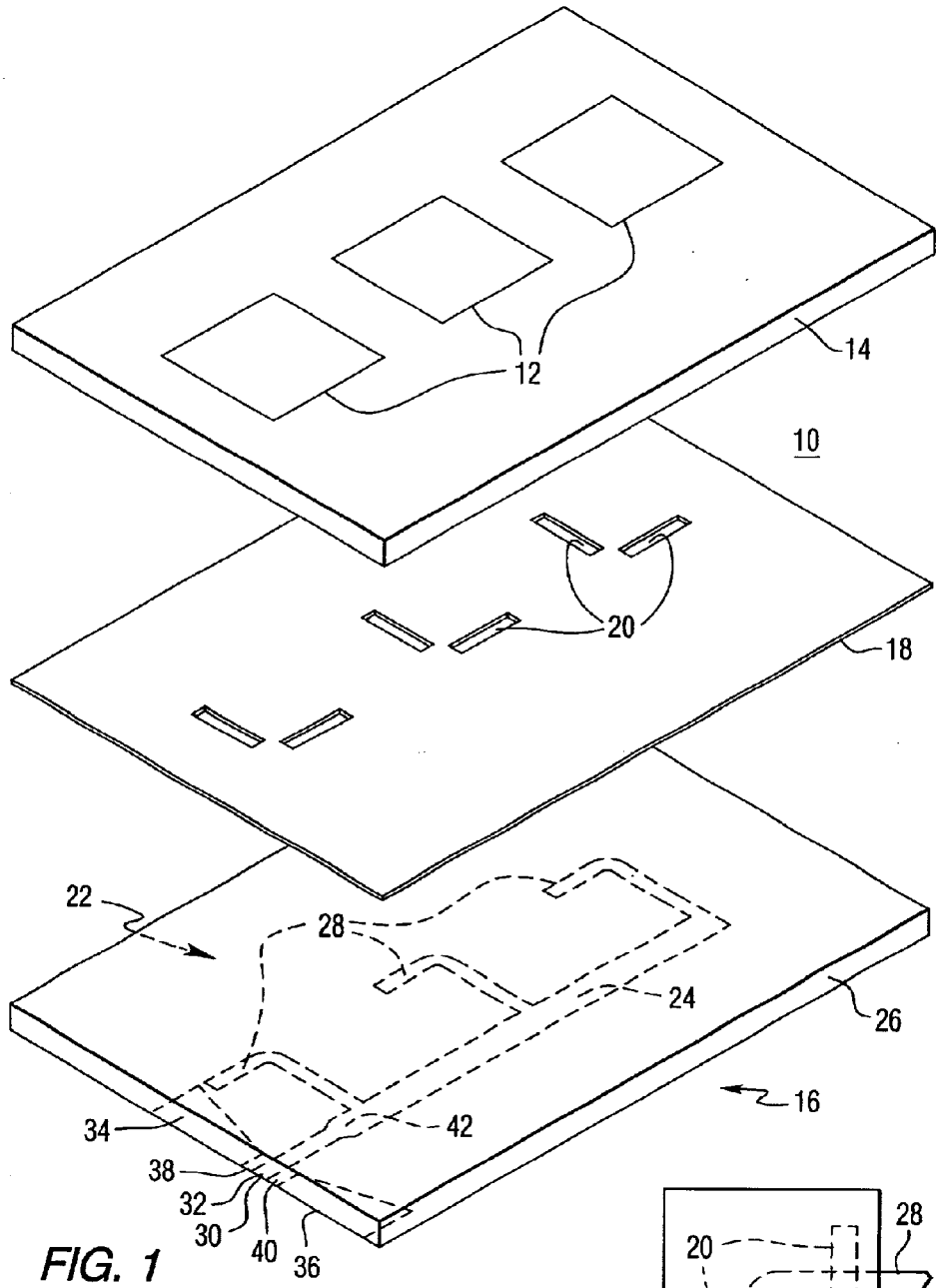
FIG. 1 is an exploded view of an aperture-coupled microstrip antenna with one serially fed column of patch elements constructed in accordance with one embodiment of the invention.

Referring to the drawings, FIG. 1 is an exploded view of an aperture-coupled microstrip antenna 10 with one serially fed column of patch elements constructed in accordance with one embodiment of the invention. The antenna includes a plurality of radiating elements in the form of square microstrip patches 12. The microstrip patches are fabricated on regular low dielectric constant material 14, such as Rohacell® foam. The foam has high thickness (>2 mm) to provide wide bandwidth. Usually thicker foam produces a wider bandwidth. However, thick foam degrades efficiency. Typical foam thickness is about 12.5% to 25% of wavelength. The symmetry of the square patches 12 helps to maintain the circular polarization of the antenna. The microstrip patch elements are coupled to a feed assembly 16 through a ground plane 18 having a plurality of apertures 20. The ground plane is preferably made of copper. The apertures are elongated, that is, they are longer in one direction than in a perpendicular direction. In the preferred embodiment, the apertures are rectangular. Other aperture shapes could be used. The choice of a particular aperture shape depends on bandwidth and processing tolerance. The apertures are arranged in orthogonal pairs, so that the major axes of the apertures in each pair lie at substantially 90° angle with respect to each other, to make circular polarization.

The feed assembly 16 includes a coplanar waveguide 22 coupled to a linear microstrip line 24, both of which are mounted on the bottom of a substrate 26. A plurality of additional microstrip lines 28 extend substantially perpendicularly from the linear microstrip line 24. Each of the additional microstrip lines is bent so that it lies beneath a pair of the apertures. The coplanar waveguide includes an input 30 coupled to a central strip line 32 and a pair of ground plane electrodes 34 and 36 positioned on the sides of the central strip line 32 and separated from the central strip line 32 by gaps 38 and 40. A transition portion 42 at the end of the coplanar waveguide couples the waveguide to the microstrip line 24. To make the conductor patterns on the substrate, both sides are initially coated with copper. Then etching processing is used to obtain specific patterns as seen on the metal sheet 18 and the bottom side of substrate 16. The microstrip lines in the feed assembly usually have a characteristic impedance of 50 ohms. However, the coplanar waveguide phase shifter has a characteristic of about 20 ohms. Impedance matching is necessary to transform the difference. The tapered ends of conductors 34 and 36 transform the coplanar waveguide phase shifter to 50 ohms. Then the 50 ohm coplanar waveguide is coupled to the 50 ohm microstrip line.

Figure 2:
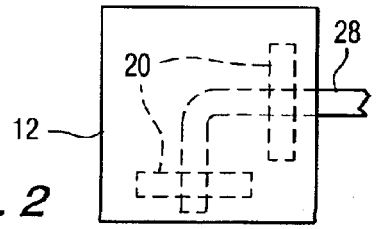
FIG. 2 is top plan view of one of the radiating elements of the antenna of FIG. 1.

FIG. 1 shows an aperture-coupled microstrip antenna with one serially fed column of patch elements. The microstrip patch elements are square with a length of approximately half of the wavelength of the guided RF signal, and fabricated on low dielectric constant thick (>2 mm) materials, such as Rohacell® foam. The symmetry of the is: square patches helps to maintain circular polarization. Since circular polarization can be generated by exciting two orthogonal patch modes in phase quadrature, each microstrip patch is fed by two orthogonal slots with 900 phase difference with respect to each other to create circular polarization. One perpendicularly bent microstrip line on the feed substrate, having a dielectric constant of about 2 to 3, feeds the two apertures. The length of the microstrip line between the two orthogonal slots causes the 90° phase difference. FIG. 2 is top plan view of one of the radiating elements of the antenna of FIG. 1.

Figure 3:
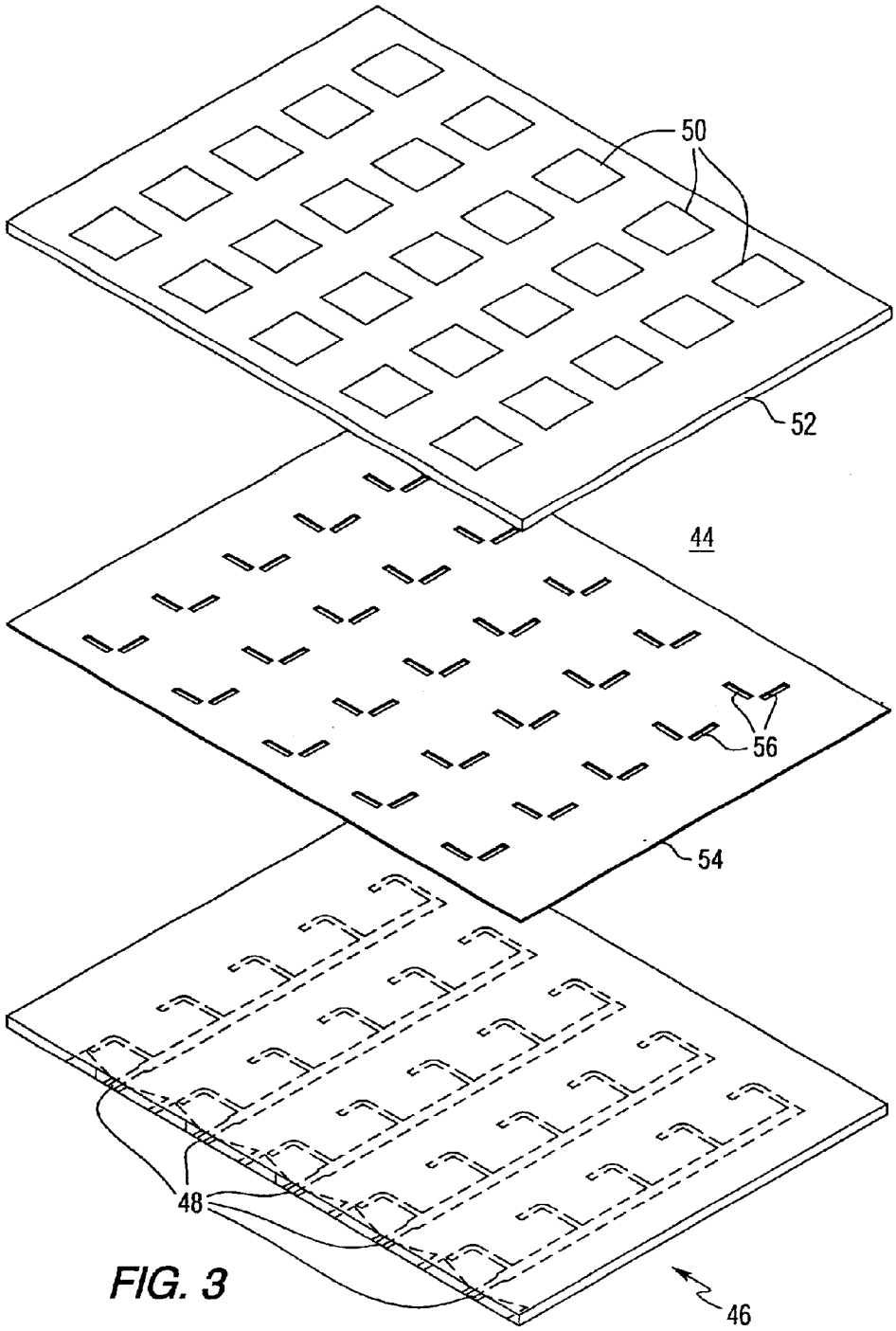
FIG. 3 is an exploded view of an aperture-coupled microstrip antenna with five serially fed columns of patch elements constructed in accordance with another embodiment of the invention.

FIG. 3 shows the structure of a phased array antenna 44 with a feed assembly 46 having five coplanar phase shifters 48 and a 5×5 array of patch radiating elements 50 mounted on substrate 52. Ground plane 54 includes a plurality of paired orthogonal apertures 56 that couple signals from the feed assembly 46 to the radiating elements 50. The feed assembly includes multiple coplanar waveguides and strip lines that are similar to those shown in FIG. 1. Antenna 44 is an example of the circularly polarized aperture-coupled microstrip antennas steered by ferroelectric CPW phase shifters. One CPW phase shifter controls the phase of each column of microstrip patches to get two-dimensional scanning.

Figure 4:
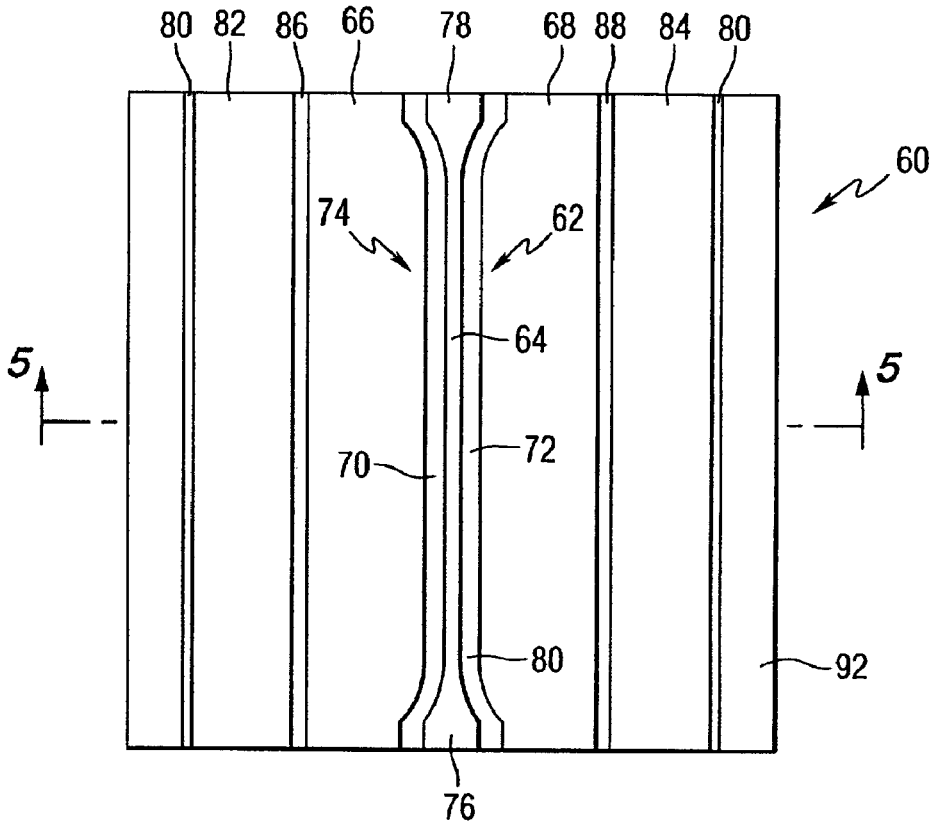
FIG. 4 is a top plan view of a coplanar waveguide phase shifter that can be used in an antenna constructed in accordance with the present invention.
Figure 5:
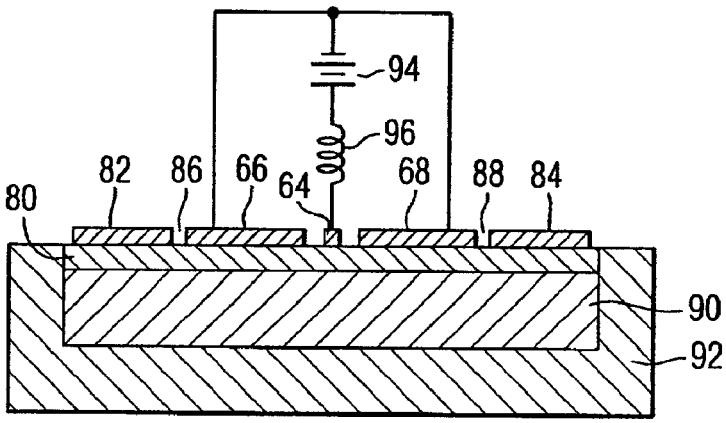
FIG. 5 is a cross-sectional view of the phase shifter of FIG. 4, taken along line 4—4.

FIG. 4 is a top plan view of a 30 GHz 360° coplanar waveguide phase shifter assembly 60 that can be used in phased array antennas constructed in accordance with this invention. FIG. 5 is a cross-sectional view of the phase shifter assembly 60 of FIG. 4, taken along line 5—5. The phase shifter is fabricated on a tunable dielectric film 80 with dielectric constant (permittivity) of around 300 and thickness of 10 micrometer. The film is deposited on a low dielectric constant (~10) substrate 90. The thickness of the film can be adjusted from 0.5 to 10 micrometers depending on deposition methods. Also, other processing which offers room temperature deposition could be used to deposit the film directly onto the substrate.

Assembly 60 includes a main coplanar waveguide 62 including a center line 64 and a pair of ground plane conductors 66 and 68 separated from the center line by gaps 70 and 72. The center portion 74 of the coplanar waveguide has a characteristic impedance of 10 around 20 ohms. Two tapered matching sections 76 and 78 are positioned at the ends of the waveguide and form impedance transformers to match the 20-ohm impedance to a 50-ohm impedance. Coplanar waveguide 62 is positioned on a layer of tunable dielectric material 80.

Conductive electrodes 66 and 68 are also located on the tunable dielectric layer and form the CPW ground plane. Additional ground plane electrodes 82 and 84 are also positioned on the is surface of the tunable dielectric material 80. Electrodes 82 and 84 also extend around the edges of the waveguide as shown in FIG. 5. Electrodes 66 and 68 are separated from electrodes 82 and 84 respectively by gaps 86 and 88. Gaps 86 and 88 block DC voltage so that DC voltage can be biased on the CPW gaps. The widths of the electrodes 66 and 68 are about 0.5 mm. For dielectric constant ranging from about 200 to 400 and an MgO substrate, the center line width and gaps are about 10 to 60 micrometers. The tunable dielectric material 80 is positioned on a planar surface of a low dielectric constant (about 10) substrate 90, which in the preferred embodiment is MgO with thickness of 0.25 mm. However, the substrate can be other materials, such as $LaAlO_3$, sapphire, $Al_2O_3$ and other ceramic substrates. A metal holder 92 extends along the bottom and the sides of the waveguide. A bias voltage source 94 is connected to strip 64 through inductor 96.

The ground planes of the coplanar waveguide and the microstrip line are connected to each other through the side edges of the substrate. The phase shifting results from dielectric constant tuning by applying a DC voltage across the gaps of the coplanar waveguide. The coplanar waveguide voltage-tuned phase shifters utilize low loss tunable dielectric films. In the preferred embodiments, the tunable dielectric film is a Barium Strontium Titanate (BST) based composite ceramic, having a dielectric constant that can be varied by applying a DC bias voltage and can operate at room temperature.

The tunable dielectric used in the preferred embodiments of phase shifters of this invention has a lower dielectric constant than conventional tunable materials. The dielectric constant can be changed by 20% to 70% at 20 V/$\mu$m, typically about 50%. The magnitude of the bias voltage varies with the gap size, and typically ranges from about 300 to 400 V for a 20 $\mu$m gap. Lower bias voltage levels have many benefits, however, the required bias voltage is dependent on the device structure and materials. The phase shifter of FIGS. 4 and 5 is designed to have 360° phase shift. The dielectric constant can range from 70 to 600 V, and typically from 300 to 500 V. In the preferred embodiment, the tunable dielectric is a Barium Strontium Titanate (BST) based film having a dielectric constant of about 500 at zero bias voltage. The preferred material will exhibit high tuning and low loss. However, tunable material usually has higher tuning and higher loss. The preferred embodiments utilize materials with tuning of around 50%, and loss as low as possible, which is in the range of (loss tangent) 0.01 to 0.03 at 24 GHz. More specifically, in the preferred embodiment, the composition of the material is a barium strontium titanate ($Ba_xSr_{1-x}TiO_3$, BSTO, where x is less than 1), or BSTO composites with a dielectric constant of 70 to 600, a tuning range FROM 20 to 60%, and a loss tangent 0.008 to 0.03 at K and Ka bands. The tunable dielectric layer may be a thin or thick film. Examples of such BSTO composites that possess the required performance parameters include, but are not limited to: BSTO-MgO, BSTO-$MgAl_2O_4$, BSTO-$CaTiO_3$, BSTO-$MgTiO_3$, BSTO-$MgSrZrTiO_6$, and combinations thereof.

The K and Ka band coplanar waveguide phase shifters of the preferred embodiments of this invention are fabricated on a tunable dielectric film with a dielectric constant (permittivity) $\epsilon$ of around 300 to 500 at zero bias and a thickness of 10 micrometer. However, both thin and thick films of the tunable dielectric material can be used. The film is deposited on a low dielectric constant substrate MgO only in the CPW area with thickness of 0.25 mm. For the purposes of this description a low dielectric constant is less than 25. MgO has a dielectric constant of about 10. However, the substrate can be other materials, such as $LaAlO_3$, sapphire, $Al_2O_3$ and other ceramics. The thickness of the film of tunable material can be adjusted from 1 to 15 micrometers depending on deposition methods. The main requirements for the substrates are their chemical stability, reaction with the tunable film at film firing temperature (~1200° C.), as well as dielectric loss (loss tangent) at operation frequency.

Figure 6:
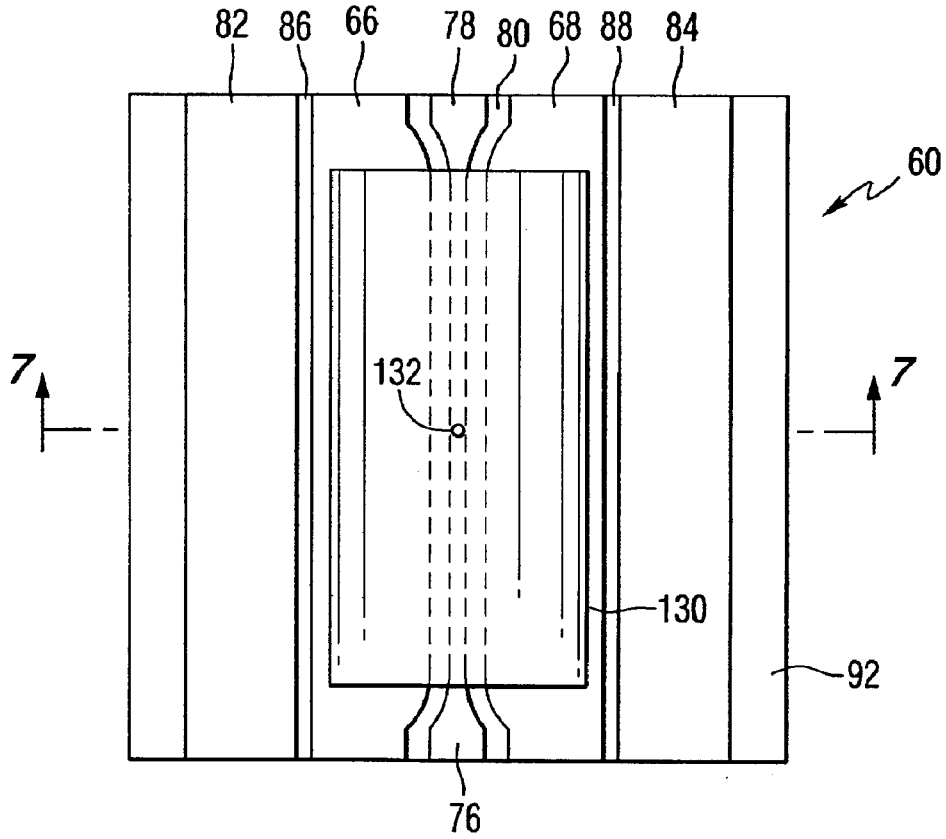
FIG. 6 is a top plan view of another phase shifter that can be used in an antenna constructed in accordance with the present invention.
Figure 7:
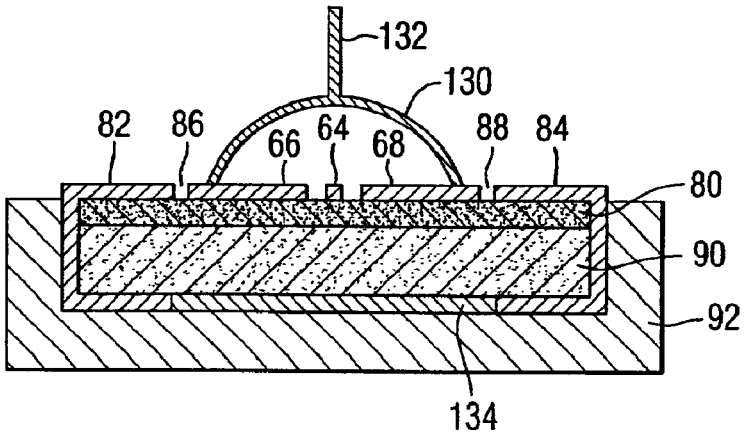
FIG. 7 is a cross-sectional view of the phase shifter of FIG. 6, taken along line 7—7.

FIG. 6 is a top plan view of the phase shifter assembly 42 of FIG. 4 with a bias dome 130 added to connect the bias voltage to ground plane electrodes 66 and 68. FIG. 7 is a cross-sectional view of the phase shifter assembly 60 of FIG. 6, taken along line 7—7. The dome connects the two ground planes of the coplanar waveguide, and covers the main waveguide line. An electrode termination 132 is soldered on the top of the dome to connect to the DC bias voltage control. Another termination (not shown) of the DC bias control circuit is connected to the central line 64 of the coplanar waveguide. In order to apply the bias DC voltage to the CPW, small gaps 86 and 88 are made to separate the inside ground plane electrodes 66 and 68, where the DC bias dome is located, and the other part (outside) of ; the ground plane (electrodes 82 and 84) of the coplanar waveguide. The outside ground plane extends around the sides and bottom plane of the substrate. The outside or the bottom ground plane is connected to an RF signal ground plane 134. The positive and negative electrodes of the DC source are connected to the dome 130 and the center line 64, respectively. The small gaps in the ground plane work as a DC block capacitors, which block DC voltage. However, the capacitance should be high enough to allow RF signal through it. The dome electrically connects ground planes 66 and 68.

Figure 8:
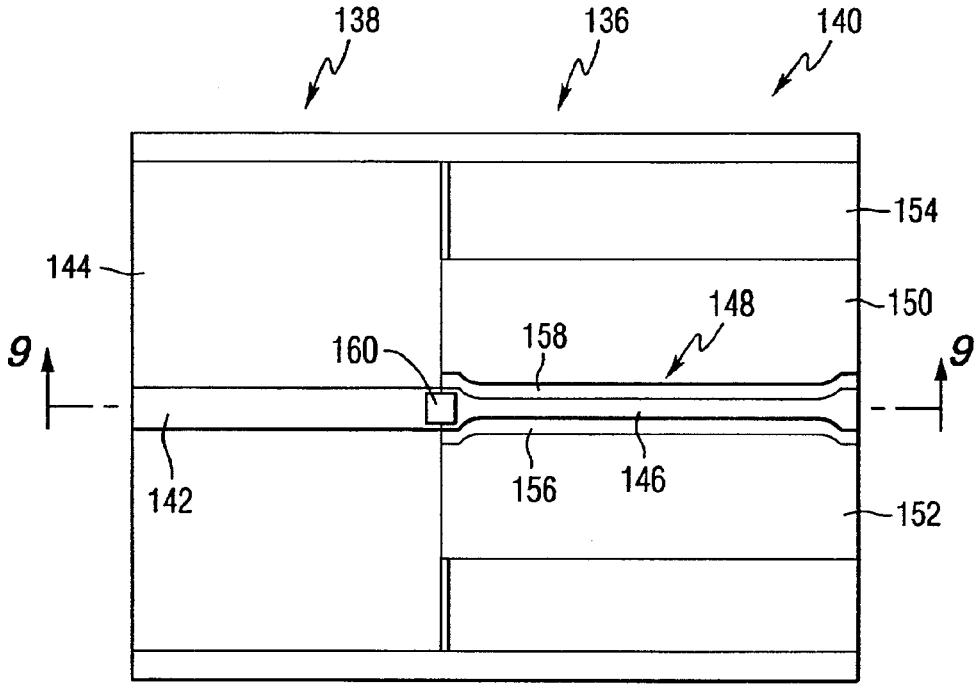
FIG. 8 is a top plan view of another phase shifter that can be used in an antenna constructed in accordance with the present invention.
Figure 9:
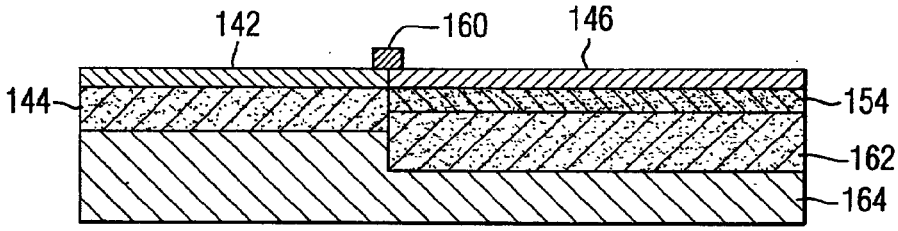
FIG. 9 is a cross-sectional view of the phase shifter of FIG. 8, taken along line 9—9.

A microstrip line and the coplanar waveguide line can be connected to one transmission line. FIG. 8 is a top plan view of another phase shifter 136. FIG. 9 is a cross-sectional view of the phase shifter of FIG. 8, taken along line 9—9. FIGS. 8 and 9 show how the microstrip 138 line transforms to the coplanar waveguide assembly 140. The microstrip 138 includes a conductor 142 mounted on a substrate 144. The conductor 142 is connected, for example by soldering or bonding, to a central conductor 146 of coplanar waveguide 148. Ground plane conductors 150 and 152 are mounted on a tunable dielectric material 154 and separated from conductor 146 by gaps 156 and 158. In the illustrated embodiment, bonding 160 connects conductors 142 and 146. The tunable dielectric material 154 is mounted on a surface of a non-tunable dielectric substrate 162. Substrates 144 and 162 are supported by a metal holder 164.

Since the gaps in the coplanar waveguides (<0.04 mm) are much smaller than the thickness of the substrate (0.25 mm), almost all RF signals are transmitted through the coplanar waveguide rather than the microstrip line. This structure makes it very easy to transform from the coplanar waveguide to a microstrip line without the necessity of a via or coupling transformation.

Figure 10:
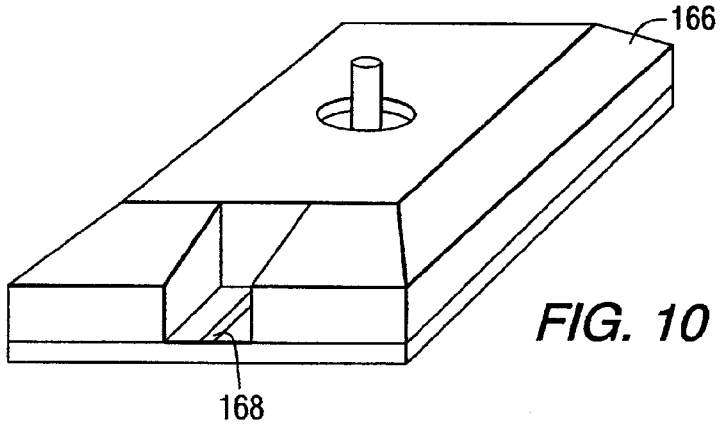
FIG. 10 is an isometric view of a phase shifter that can be used in an antenna constructed in accordance with the present invention.

FIG. 10 is an isometric view of a phase shifter for an antenna constructed in accordance with the present invention. A housing 166 is built over the bias dome to cover the whole phase shifter such that only two 50 ohm microstrip lines are exposed to connect to an external circuit. Only line 168 is shown in this view.

Figure 11:
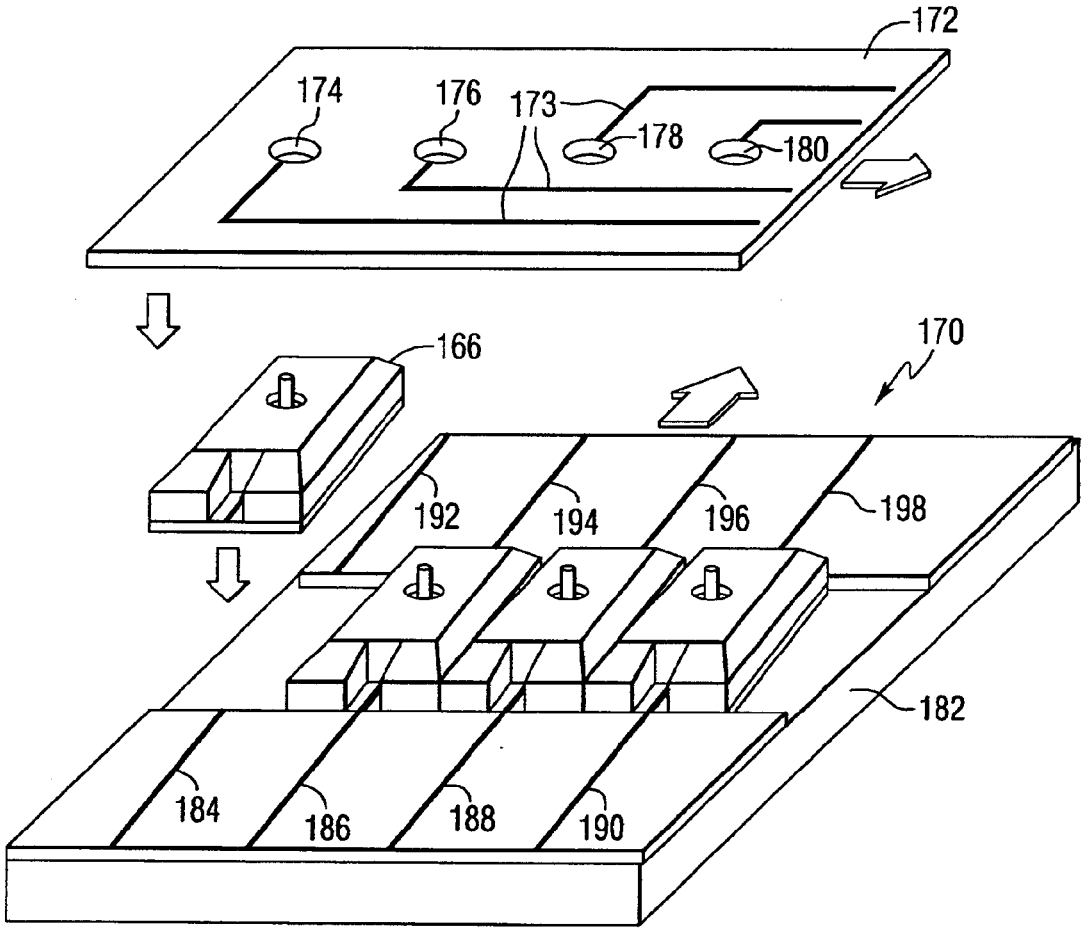
FIG. 11 is an exploded isometric view of an may of phase shifters that can be used in an antenna constructed in accordance with the present invention.

FIG. 11 is an exploded isometric view of an array 170 of 30 GHz coplanar waveguide phase shifters constructed in accordance with the present invention, for use in a phased array antenna. A bias line plate 172, made of an insulating material and supporting a bias network 173, is used to cover the phase shifter array and to connect bias voltages to the phase shifters. The electrodes on the dome of each phase shifter are soldered to the bias lines on the bias line plate through the holes 174, 176, 178 and 180. The phase shifters are mounted in a holder 182 that includes a plurality of microstrip lines 184, 186, 188, 190, 192, 194, 196 and 198 for connecting the radio frequency input and output signals to the phase shifters. The particular structures shown in FIG. 11, provide each phase shifter with its own protective housing. The phase shifters are assembled and tested individually before being installed in the phased array antenna. This significantly improves yield of the antenna, which usually has tens to thousands phase shifters.

To construct the phased array antenna, phase shifters are built individually as shown in FIG. 7. The coplanar waveguides are coupled to the microstrip lines, such as by soldering, as shown in FIGS. 8 and 9. A metal housing is placed on the phase shifter as shown in FIG. 10. The radiation patches, aperture coupling and feed line are built as shown in FIG. 3, but without the phase shifters 48. The end lines of the antenna board are shown as lines 192, 194, 196 and 198 of FIG. 11. Finally, the individual phase shifters are mounted in the board as shown in FIG. 11.

The phase shifters include a substrate, a tunable dielectric film having a dielectric constant between 70 to 600, a tuning range of 20 to 60%, and a loss tangent between 0.008 to 0.03 at K and Ka bands positioned on a surface of the substrate, a coplanar waveguide positioned on a surface of the tunable dielectric film opposite the substrate, an input for coupling a radio frequency signal to the coplanar waveguide, an output for receiving the radio frequency signal from the coplanar waveguide, and a connection for applying a control voltage to the tunable dielectric film. The devices herein are unique in design and exhibit low insertion loss even at frequencies in the K and Ka bands.

The coplanar phase shifters of the preferred embodiments of this invention are fabricated on the voltage-tuned Barium Strontium Titanate (BST) based composite films. The BST composite films have excellent low dielectric loss and reasonable tunability. These K and Ka band coplanar waveguide phase shifters provide the advantages of high power handling, low insertion loss, fast tuning, loss cost, and high anti-radiation properties compared to semiconductor based phase shifters. It is very common that dielectric loss of materials increases with frequency. Conventional tunable materials are very lossy, especially at K and Ka bands. Coplanar phase shifters made from conventional tunable materials are extremely lossy, and useless for phased array antennas at K and Ka bands. It should be noted that the phase shifter structures of the present invention are suitable for any tunable materials. However, only low loss tunable materials can achieve good, useful phase shifters. It is desirable to use low dielectric constant material for microstrip line phase shifter, since high dielectric constant materials easily generate high EM modes at these frequency ranges for microstrip line phase shifters. However, no such low dielectric constant conventional materials (<100) are available.

The preferred embodiments of the phase shifters in antennas of the present invention use composite materials, which include BST and other materials, and two or more phases. These composites show much lower dielectric loss, and reasonable tuning, compared to conventional ST or BST films. These composites have much lower dielectric constants than conventional ST or BST films. The low dielectric constants make it easy to design and manufacture phase shifters. These phase shifters can operate at room temperature (~300° K). Room temperature operation is much easier, and much less costly than prior art phase shifters that operate at 100° K.

The present invention provides a low-cost electrically scanned phased array antenna for tracking ground terminals and spacecraft communication or radar applications. The preferred embodiment of the invention comprises room temperature voltage-tuned coplanar waveguide (CPW) phase shifters and a circularly polarized microstrip phased antenna. The coplanar phase shifters are fabricated on the voltage-tuned Barium Strontium Titanate (BST) based composite films. The BST composite films have excellent low dielectric loss and reasonable tunability. These CPW phase shifters have the advantages of high power handling, low insertion loss, fast tuning, low cost, and high anti-radiation properties compared to semiconductor based phase shifters. The phased array antenna includes square microstrip patches fed by coupling aperture through two orthogonal slots for circular polarization. The aperture-coupled microstrip antenna provides several advantages over transmission line or probe fed patch antennas, such as more space for a feed network, the elimination of a need for a via, easy control of input impedance, excellent circular polarization, and low cost. The aperture-coupled microstrip antenna has an additional advantage for voltage-tuned phase shifters, since no DC block is needed between phase shifters and radiation patches. This advantage makes the phase shifters safe and easy to bias.

The preferred embodiment of present invention uses CPW voltage-tuned phase shifters, which are suitable for higher frequency applications such as above Ku band compared to the microstrip phase shifter. The CPW phase shifter also shows wider bandwidth, lower bias voltage and simpler structure than the microstrip phase shifter. The aperture-coupled technique has a unique advantage for this voltage-tuned phase shifter application, because no DC isolation is needed between the phase shifter and the radiation elements. This advantage makes the antenna system simpler, safer, and low expensive.

While the invention has been described in terms of what are at present its preferred embodiments, it will be apparent to those skilled in the art that various changes can be made to the preferred embodiments without departing from the scope of the invention, which is defined by the claims.

What is claimed is:

1. A phased array antenna comprising:

a plurality of radiating elements;

a feed line assembly;

a ground plane positioned between the plurality of radiating elements and the feed line assembly;

a phase shifter coupled to the feed line assembly, the phase shifter comprising a tunable dielectric film having a dielectric constant tunable at approximately 300 degrees K;

the ground plane having a plurality of pairs of orthogonal openings, each pair of orthogonal openings positioned adjacent to one of the radiating elements; and the feed line assembly including a plurality of microstrip lines, each of the microstrip lines including a first portion positioned adjacent to one of the pairs of orthogonal openings.

2. A phased array antennas as recited in claim 1, wherein:

the openings are elongated.

3. A phased array antenna as recited in claim 1, further comprising:

a linear microstrip line connected to the plurality of microstrip lines, wherein each of the plurality of microstrip lines extends perpendicularly from the linear microstrip line.

4. A phased array antenna as recited in claim 3, wherein the plurality of radiating elements are arranged in a plurality of rows and columns, and wherein the feed line assembly further comprises:

additional linear microstrip lines and additional pluralities of microstrip lines extending perpendicularly from the additional linear microstrip lines.

5. A phased array antenna as recited in claim 1, wherein:

the first portion of each of the plurality of microstrip lines includes a 90° bend, and the bend is positioned between sections of the first portion that are positioned adjacent to the orthogonal openings in one of the pairs of orthogonal openings.

6. A phased array antenna as recited in claim 1, wherein:

the first portion of each of the plurality of microstrip lines has a predetermine length for providing a 90° phase shift between the openings of an adjacent one for pairs of orthogonal openings.

7. A phased array antenna as recited in claim 1, wherein the phase shifter comprises:

a first substrate;

the tunable dielectric film positioned on a surface of the first substrate;

a coplanar waveguide positioned on a surface of the tunable dielectric film opposite the first substrate;

an input for coupling a radio frequency signal to the coplanar waveguide;

an output for receiving the radio frequency signal from the coplanar waveguide; and a connection for applying a control voltage to the tunable dielectric film.

8. A phased array antenna as recited in claim 7, further comprising:

a first impedance matching section of the coplanar waveguide coupled to the input; and a second impedance matching section of the coplanar waveguide coupled to the output.

9. A phased array antenna as recited in claim 8, further wherein the first impedance matching section comprises a first tapered coplanar waveguide section; and wherein the second impedance matching section comprises a second tapered coplanar waveguide section.

10. A phased array antenna as recited in claim 7, wherein the connection for applying a control voltage to the turntable dielectric film comprises:

a first electrode position adjacent a first side of a conductive strip of the coplanar waveguide to form a first gap between the first electrode and the conductive strip; and a second electrode position adjacent a second side of the conductive strip to form a second gain between the second electrode and the conductive strip.

11. A phased array antenna as recited in claim 10, further comprising:

a third electrode position adjacent a first side of the first electrode opposite the conductive strip to form a third gap between the first electrode and the third electrode; and a fourth electrode position adjacent a first side of the second electrode opposite the conductive strip to form a fourth gap between the second electrode and the fourth electrode.

12. A phased array antenna as recited in claim 10, further comprising:

a conductive dome electrically connected between the first and second electrodes.

13. A phased array antenna as recited in claim 7, wherein the substrate comprises MgO, LaAlO 3, Al2O3, and a ceramic.

14. A phased array antenna as recited in claim 7, wherein the substrate has a dielectric constant of less than 25.

15. A phased array antennas as recited in claim 7, wherein the tunable dielectric film has a dielectric constant of greater than 300.

16. A phased array antenna as recited in claim 7, wherein the phase shifter further comprises:

a second substrate positioned adjacent to an end of the first substrate;

a microstrip line positioned on a surface of the second substrate; and a connection between the microstrip line and a conductive strip of the waveguide.

17. A phased array antenna as recited in claim 7, wherein the tunable dielectric film comprises one of the group of:

barium strontium titanate ($BaxSr_{1-x}TiO_3$, BSTO, where x is less than 1) BSTO-MgO, BSTO-$MgAl_2O_4$, BSTO-$CaTiO_3$, BSTO-$MgTiO_3$, BSTO-$MgSrZrTiO_6$, and combinations thereof.

18. A phased array antenna as recited in claim 7, wherein the tunable dielectric film comprises a barium strontium titanate composite.

19. A phased array antenna as recited in claim 7, wherein the tunable dielectric film has a dielectric constant between 70 and 600, a tuning range of 20 to 60%, and a loss tangent between 0.008 and 0.03 at K and Ka bands.

20. A phased array antenna as recited in claim 1, further comprising:

a conductive housing enclosed the phase shifter.

* * * * *